US007812273B2

(12) United States Patent
Takahara et al.

(10) Patent No.: US 7,812,273 B2
(45) Date of Patent: Oct. 12, 2010

(54) SWITCHGEAR APPARATUS

(75) Inventors: Osamu Takahara, Tokyo (JP); Tae Hyun Kim, Tokyo (JP); Tomotaka Yano, Tokyo (JP); Akihiko Imagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 639 days.

(21) Appl. No.: 11/835,690

(22) Filed: Aug. 8, 2007

(65) Prior Publication Data

US 2008/0047819 A1 Feb. 28, 2008

(30) Foreign Application Priority Data

Aug. 25, 2006 (JP) ..... 2006-229553

(51) Int. Cl.
*H01H 1/64* (2006.01)

(52) U.S. Cl. ..... 200/293; 218/154

(58) Field of Classification Search ..... 200/293, 200/288; 218/2, 7, 14, 78, 84, 120, 140, 218/153, 154
See application file for complete search history.

(56) References Cited

U.S. PATENT DOCUMENTS

| | | | | |
|---|---|---|---|---|
| 4,099,039 | A | 7/1978 | Barkan | |
| 2003/0089683 | A1 * | 5/2003 | Thuresson et al. | 218/154 |
| 2006/0086694 | A1 * | 4/2006 | Benke et al. | 218/154 |

FOREIGN PATENT DOCUMENTS

| | | | |
|---|---|---|---|
| DE | 18 15 722 | C3 | 9/1969 |
| DE | 42 01 956 | A1 | 7/1993 |
| DE | 199 25 191 | A1 | 11/2000 |
| DE | 102 24 449 | B3 | 2/2004 |
| JP | 2002-124157 | | 4/2002 |
| JP | 2002-124165 | | 4/2002 |
| JP | 2004-71540 | | 3/2004 |
| JP | 2006-164654 | | 6/2006 |

* cited by examiner

*Primary Examiner*—Edwin A. Leon
(74) *Attorney, Agent, or Firm*—Oblon, Spivak, McClelland, Maier & Neustadt, L.L.P.

(57) ABSTRACT

A switchgear apparatus is provided in which an impact induced by a close operation is mitigated, featuring space saving and high reliability with low costs.

The switchgear apparatus includes a switching unit 3 that is composed of a fixed electrode 1 and a movable electrode 2; a movable shaft 4 that is extended from the movable electrode 2; an operating mechanism 5 that produces driving force and transfers the driving force to the movable shaft 4; a switching-unit holder 6 that holds the switching unit 3 and the movable shaft 4 thereinside; and a holder supporting unit 7 that has a fixing plane so as to fix the switching-unit holder 6 thereonto. The switchgear apparatus is arranged in such a manner that the holder supporting unit 7 serving as the fixing plane is constituted of a plurality of plates layered in the axial direction along the movable shaft 4. In a case of the close operation, because kinetic energy in the overall system is consumed by the friction generated between the layered plates owing to distortion of the layered plates, energy that allows the movable electrode 2 to bounce back and forth is lowered, so that it is possible to shorten a chattering time.

5 Claims, 6 Drawing Sheets

SWITCHGEAR APPARATUS

BACKGROUND OF THE INVENTION

1. Field of the Invention

The present invention relates to switchgear apparatus that have a pair of electrodes that are able to make/break a contact therebetween, and perform open/close operations of the pair of electrodes by contacting or separating the electrodes each other, in particular, to the switchgear apparatus that are electromagnetically driven.

2. Description of the Related Art

A conventional switchgear using an electromagnetic force is constituted of a movable electrode and a fixed electrode, and further constituted of a switching unit that directly performs so as to open/close an electric circuit; a movable shaft that is extended from the movable electrode; and an operating mechanism that is driven by a power source, and opens/closes the switching unit by providing the driving force onto the movable shaft.

In such a switchgear, because the driving force originating from the electromagnetic force is utilized therein, the open/close operations tend to be performed in a high speed. Particularly in the close operation, a large striking force is produced when the movable electrode collides against the fixed electrode; because of the impact, a repetitive contact phenomenon between the electrodes (hereinafter referred to as "chattering") is generated. When a duration of the chattering or "chattering time" is long, there can be raised a problem in which the electrodes may be welded to each other; therefore, it is necessary to shorten the chattering time as much as possible. For this reason, for example, there exits a proposal in which two open/close units (interrupters) are placed in series to oppose each other and, at the same time, the fixed-side electrodes are back-to-back connected to each other and fixed; thus, by counterbalancing or canceling the striking force produced when the movable electrodes collide against the respective fixed electrodes, damage to a supporting member that supports both the fixed electrodes is prevented; concurrently, an electric circuit including the switches each in two open/close units is so arranged as to be interrupted easily and reliably (for example, refer to Japanese Patent Application Publication No. 2002-124157).

In addition, there exits another proposal in which a decelerating means (a set of dampers) is provided in an operating mechanism that opens/closes a switching unit so as to mitigate the impact caused by the open/close operations, so that the striking force is mitigated, and high-speed responsivity of the open/close operations is secured (for example, refer to Japanese Patent Application Publication No. 2002-124165).

As for a switchgear in Japanese Patent Application Publication No. 2002-124157, because two open/close units are placed in series, it is difficult to place the units without providing sufficient space therefor.

In addition, as for a switchgear in Japanese Patent Application Publication No. 2002-124165, because a configuration is taken in which expensive dampers are placed so that energy due to the impact is dampened, product costs tend to become high, which has hitherto caused a problem.

The present invention has been directed at solving those problems in conventional technologies described above, and an object of the invention is to provide switchgear apparatus that have high reliability with low costs, and are compact (space saving).

SUMMARY OF THE INVENTION

In one aspect of the present invention, a switchgear apparatus comprises: a switching unit constituted of a movable electrode and a fixed electrode, for opening/closing an electric circuit; a movable shaft extended from the movable electrode; an operating mechanism for performing, by providing driving force to the movable shaft, the open/close operations of the switching unit; a switching-unit holder for holding the switching unit and the movable shaft thereinside; and a holder supporting unit having a fixing plane, for fixing the switching-unit holder thereonto, the switchgear apparatus is characterized in that the holder supporting unit serving as the fixing plane is constituted of a plurality of plates layered in the axial direction along the movable shaft.

According to the present invention, because a fixing plane (member) that fixes the switching-unit holder thereonto has a layered structure of a plurality of plates, the fixing plane is distorted by the impact due to a close operation; according to the distortion, the layered plates are rubbed against each other; because of this, kinetic energy due to the friction is consumed, so that it is possible to shorten a chattering time.

Moreover, even when a characteristic of switchgear apparatus such as a driving velocity of the apparatus is changed, it is possible to easily control a chattering characteristic, by changing the layered structure such as the number of superimposed layers, and/or convexes and concaves provided for the layered surfaces each.

In addition, because it is not necessary to provide the space for mounting a part or parts in order to curb the chattering, without a large design modification, it is possible to obtain compact (space saving) apparatus.

In addition, a layered fixing plane is only constituted of plate material, which leads to low costs.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Hereunder, preferred embodiments according to the present invention will be described in detail with reference to the accompanying drawings.

Embodiment 1

Figure 1:
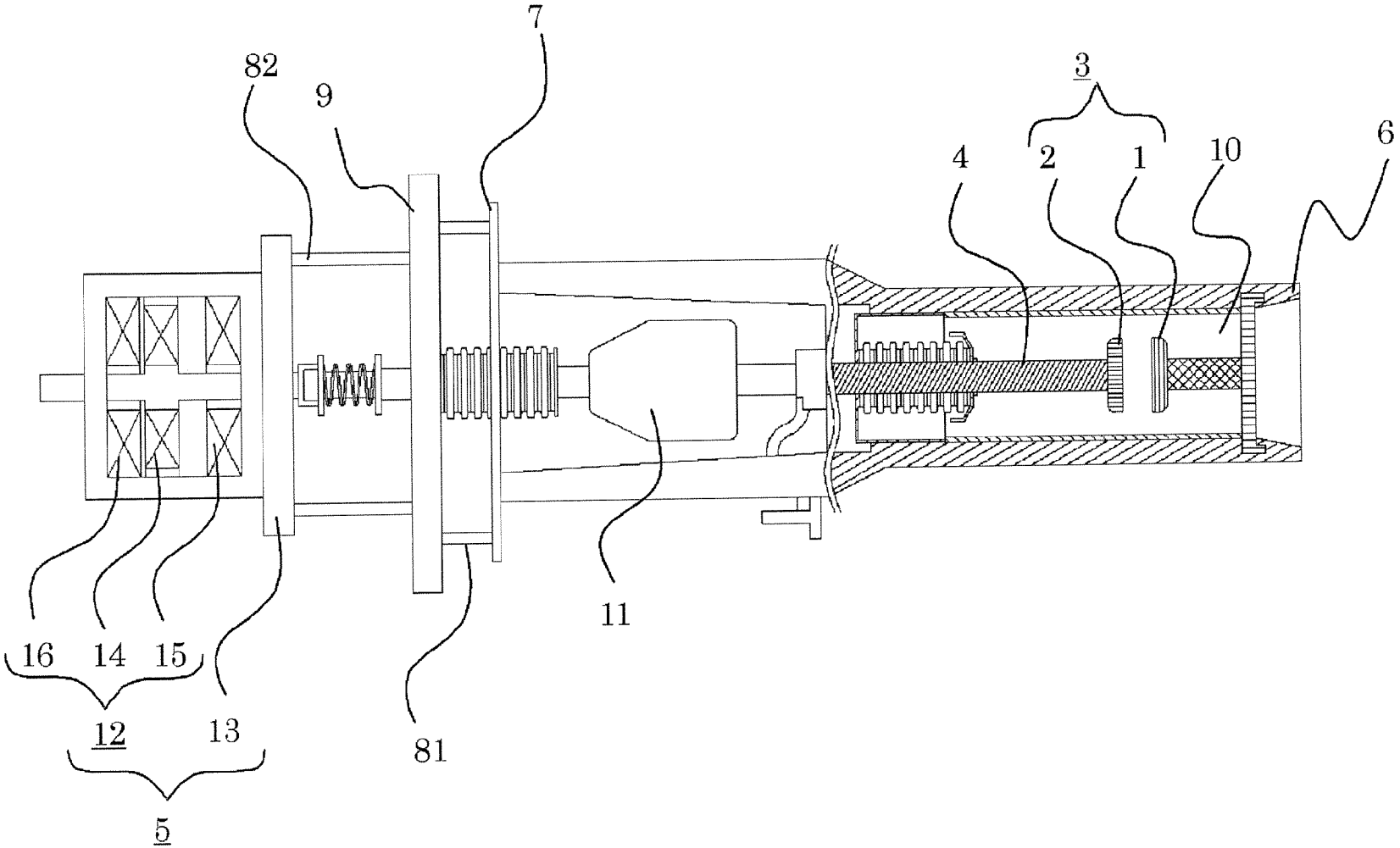
FIG. 1 is a diagram outlining a configuration of a switchgear in Embodiment 1 of the present invention.

FIG. 1 is a diagram outlining a configuration of a switchgear in Embodiment 1 of the present invention. The switchgear is constituted of a switching unit 3 that is composed of a fixed electrode 1 and a movable electrode 2; a movable shaft 4 that is extended from the movable electrode 2; an operating mechanism 5 that performs, by providing driving force to the movable shaft 4 and driving the movable shaft 4 in the axial (longitudinal) direction along the shaft, the open/close operations of the switching unit 3; a switching-unit holder 6 that holds the switching unit 3 and the movable shaft 4 thereinside; a base plate 7 (i.e., holder supporting plate or unit) that serves as a fixing plane onto which the switching-unit holder 6 is fixed; struts 81 and 82 that support the base plate 7 and the operating mechanism 5, respectively; and a flange 9 that fixes the struts 81 and 82.

In FIG. 1, the switching unit 3 has the fixed electrode 1 and the movable electrode 2, and performs, by separating or making contact between the fixed electrode 1 and the movable electrode 2, the operation to open an electric circuit (hereinafter referred to as a trip or "open operation") or the operation to close the circuit (hereinafter referred to as a "close operation"), respectively.

Note that, the switchgear in this embodiment is a model that interrupts a large current without using insulation gas; the fixed electrode 1 and the movable electrode 2 are mounted in a vacuum switch tube or vacuum valve 10.

The movable shaft 4 acts so as to transfer the driving force from the operating mechanism 5; thus, in order to prevent an intervention of the electric current into the operating mechanism 5, an insulation rod 11 is intermediately placed therein. As for the movable shaft 4, the side of the switching unit 3 viewed from the insulation rod 11 is an energized (live) portion, and the other side into the operating mechanism 5 from the insulation rod 11 is a non-energized portion.

The operating mechanism 5 includes a driving mechanism 12 that produces the driving force originating from the electromagnetic force, and a driving-mechanism holding casing 13 that holds the driving mechanism 12. The driving mechanism 12 includes a movable coil 14 that is fixed onto the non-energized portion of the movable shaft 4; a close-operation fixed coil 15 that is placed opposing to the movable coil 14 on the side of switching unit 3; and an open-operation fixed coil 16 that is placed opposing to the movable coil 14 on the other side from the side of switching unit 3.

The switching-unit holder 6 is constituted in such a manner that, in order to stabilize insulation capability, the holder is integral (molded) with the switching unit 3 therewithin.

In addition, a general circuit breaker has a structure in which three switchgears of such shown in FIG. 1 are disposed in parallel for the respective phases, e.g., "U," "V," and "W"; hence, the base plate 7 is constituted in such a manner that three switching-unit holders each like the switching-unit holder 6 can be mounted thereonto. In addition, the base plate 7 is constituted of several of the same or identical shape of iron plates that are layered in the axial direction along the movable shaft 4.

Figure 2:
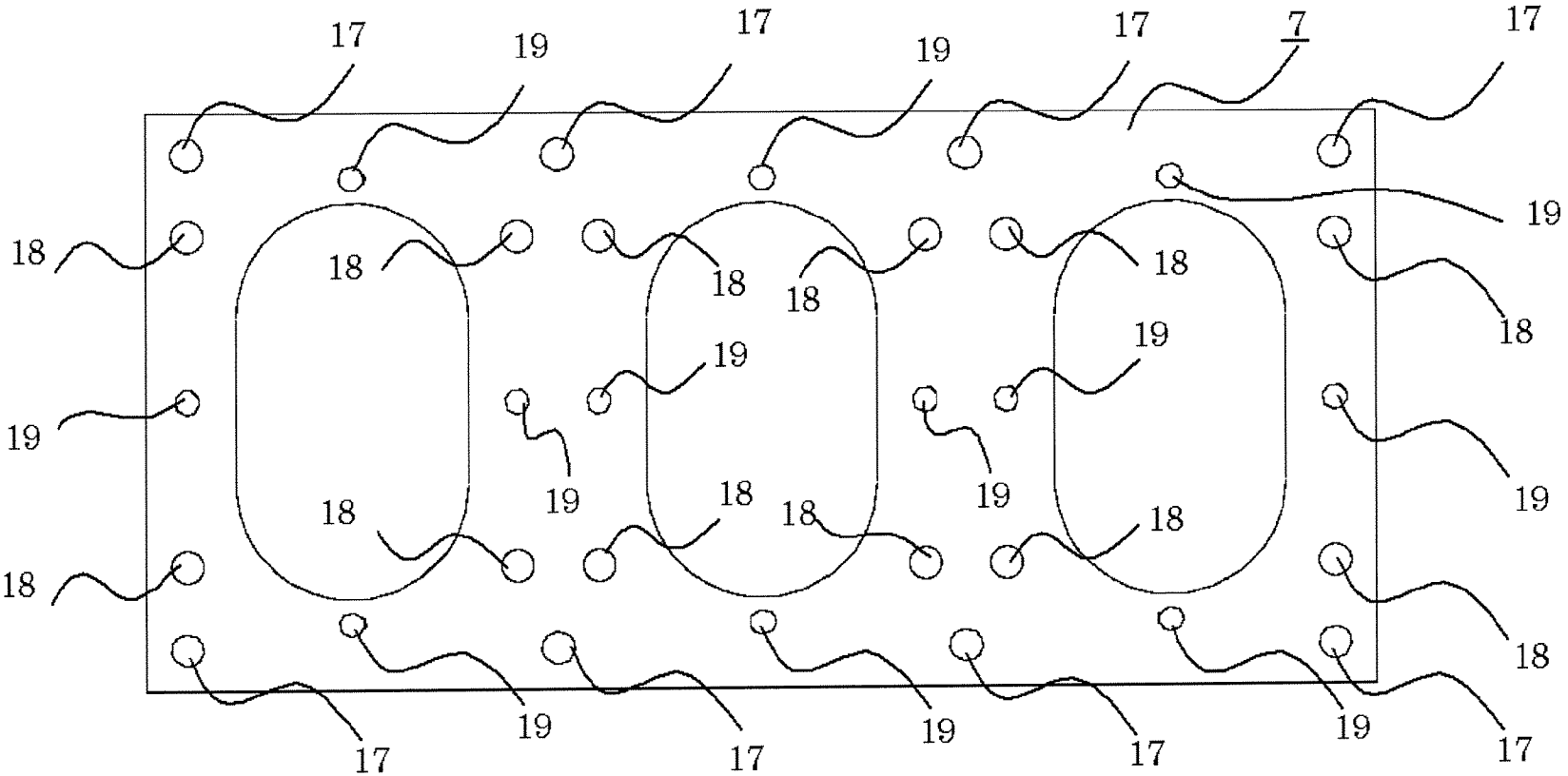
FIG. 2 is a plan diagram outlining a structure of a base plate in Embodiment 1 of the present invention.

Because the base plate 7 fixes, as described above, the switching-unit holder 6 thereonto, and then the base plate 7 is fixed onto the flange 9 by using the struts 81, as shown in FIG. 2, flange fixing bolt holes 17 and switching-unit-holder fixing bolt holes 18 are provided therewith.

Moreover, the base plate 7 is provided with, other than the bolt holes 17 and 18, layered-plate fixing-member through-holes 19; by applying bolts (i.e., fixing-members) passing through these layered-plate fixing-member through-holes 19, a plurality of plates layered is structured so as to be fastened to each other.

Figure 3:
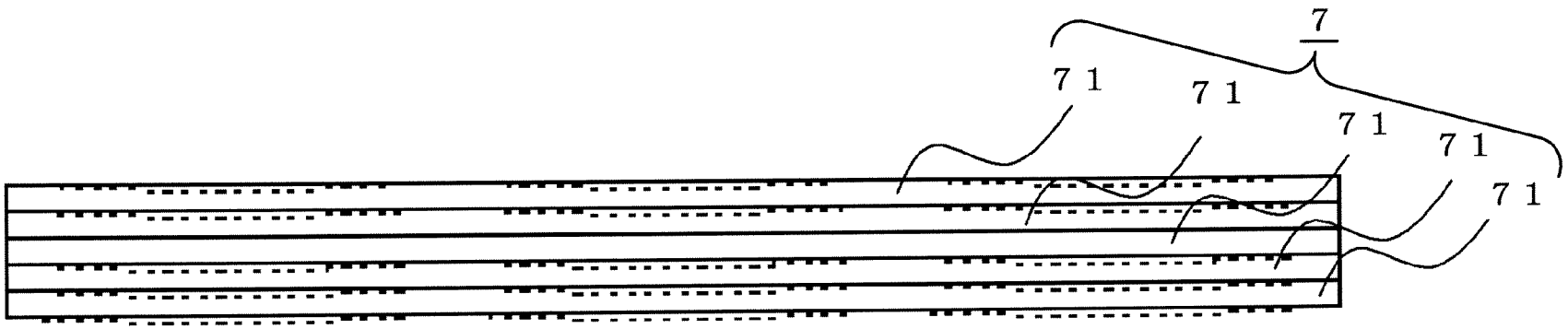
FIG. 3 is a diagram outlining behavior of the base plate in Embodiment 1 of the present invention.

According to the configuration described above, because the base plate 7 constituted of a plurality of layered plates is distorted by an impact produced according to the close operation as indicated by broken lines in FIG. 3, friction is generated between the plurality of layered plates, so that, caused by consumption of kinetic energy due to the function, it becomes possible to lower kinetic energy that allows the movable electrode 2 to bounce back and forth.

In addition, because the plurality of layered plates that composes the base plate 7 is fastened by the fixing-members, when the distortion is produced by the impact of collision, friction is more easily generated between the layered plates, so that the consumption of kinetic energy due to the friction becomes large; therefore, it is possible to further shorten a chattering duration.

Moreover, by changing the properties of material of the base plate 7, it is possible to alter the stiffness of the base plate 7; thus, it is possible to change a characteristic in the overall system.

According to the effect obtained, it becomes possible to reduce the chattering time to a large extent.

Figure 4:
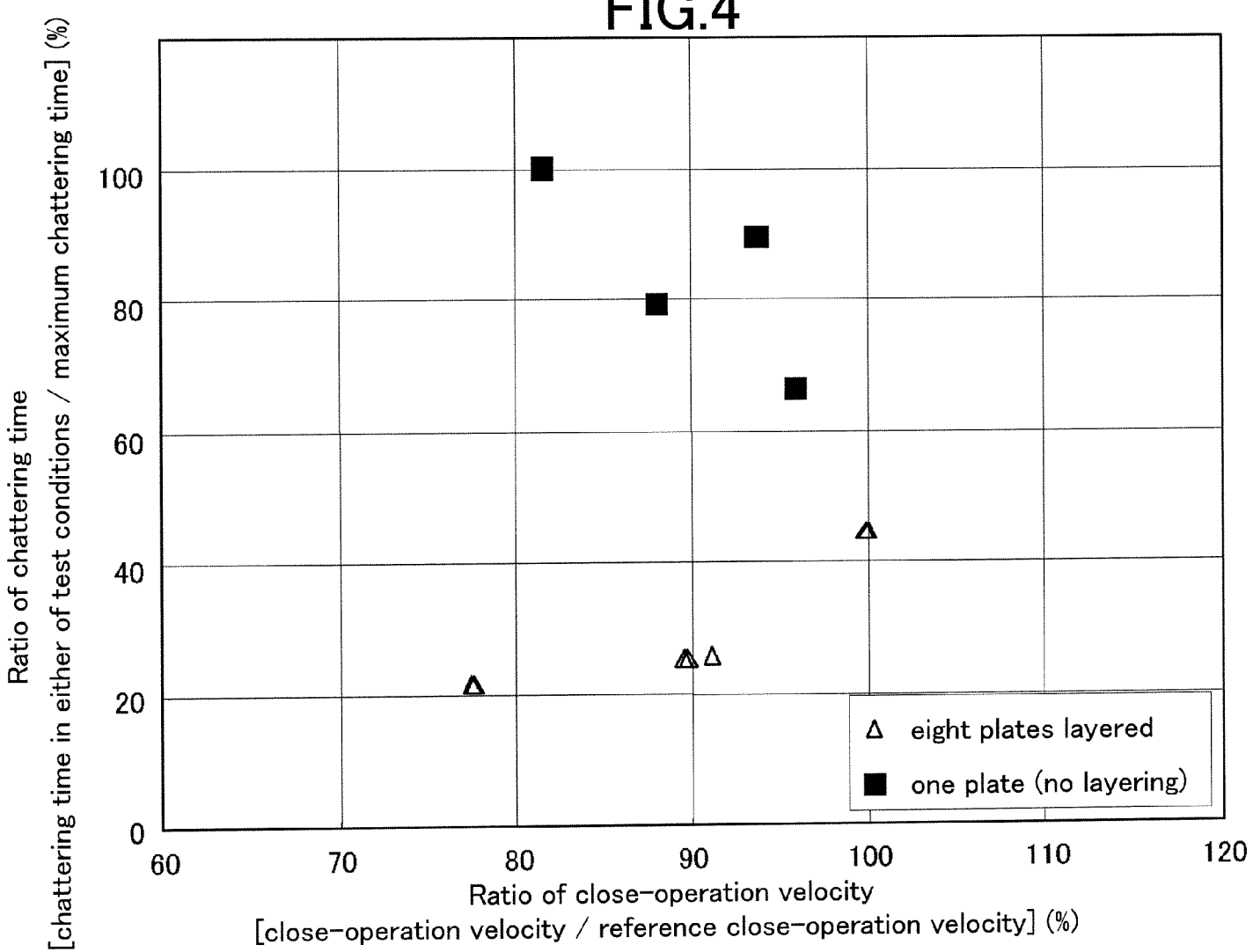
FIG. 4 is a diagram showing a ratio of chattering time in the switchgear in Embodiment 1 of the present invention, and a ratio of chattering time in a conventional switchgear.

In FIG. 4, an effect of reduction of the chattering time is shown. The horizontal axis is a ratio of close-operation velocity of the movable shaft 4 (i.e., a ratio of a close-operation velocity with respect to the close-operation velocity that is a "reference" in which, here, a shifting velocity of the movable shaft 4 becomes a maximum velocity in the configuration in Embodiment 1; note that, either of the close-operation velocities is a mean velocity from the 40 percent distance of a stroke or travel of the movable shaft 4 to the end face of the fixed electrode 1), and the vertical axis is a ratio of the chattering time (i.e., a ratio of the chattering time, in either of test conditions, with respect to a maximum chattering time in which the base plate 7 is constituted of one sheet of plate); in the same configuration, to the cases in which the base plate 7 is constituted of eight layered plates (as marked by triangles "Δ") and such a base plate is constituted of one sheet of plate (as marked by black squares "■"), the figure shows the test results obtained when the close-operation velocity has been varied and corresponding chattering time is measured.

According to the result, when Embodiment 1 of the present invention is applied, in comparison to a case when not applied, it becomes possible to reduce the chattering time down to some 20 percent in maximum.

Usually, in a switchgear using insulation gas, the switching unit 3 and the switching-unit holder 6 are not integrally molded in one piece in such a manner described in this embodiment; therefore, it is possible to place an impact-mitigating structure on the side of the fixed electrode 1 or the side of the operating mechanism 5; by letting the impact-mitigating structure consume the kinetic energy that is produced according to the close operation, it is possible to reduce the time during which the chattering occurs. However, in a case of a large-capacity switchgear in which insulation gas is not used (dry-air used), in order to stabilize insulation capability as described above, a switching unit is integrally molded with a switching-unit holder; therefore, it becomes difficult to place the impact-mitigating structure described above on the side of the fixed electrode 1.

To this end, as for a switchgear having the structure in which the switching-unit holder 6 and the switching unit 3 are integrally molded in one piece, when the configuration such as the one in this embodiment is adopted, namely in the configuration with low costs and space saving at the same time, it becomes possible to shorten the chattering time.

Furthermore, in regard to thickness, shapes, the number of superimposed layers, a layered area and the like of the plurality of layered plates that composes the base plate 7, it is preferable to constitute the layered plates each has not only the thickness, the shapes and the like which can fasten and support the switching-unit holder 6, but also an optimum chattering time (usually, several milliseconds or less).

Embodiment 2

Figure 5:
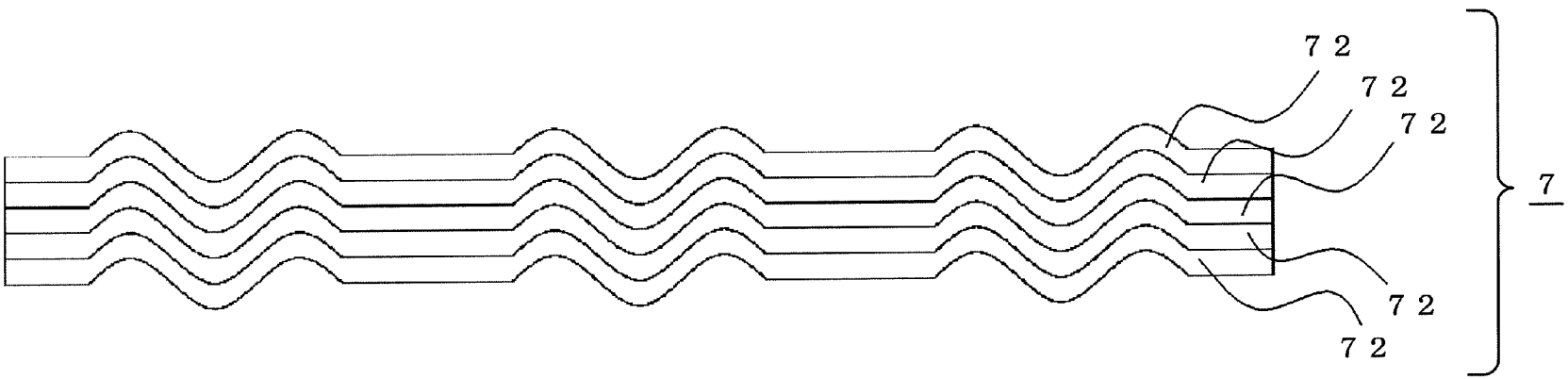
FIG. 5 is a cross-sectional diagram outlining a configuration of a base plate in Embodiment 2 of the present invention.

In Embodiment 1, a shape of the plurality of layered plates that composes the base plate 7 is of a flat-shaped plate in which the thickness of each plate is constant; however, for example, as shown in FIG. 5, it may be possible to constitute a cross-sectional shape of layered plates each partly waved in the same or identical shape, and each plate is layered on one another with its convexes and concaves neatly coincided.

According to this configuration, in comparison to a case with usual (flat-shaped) plates used, the contacting area is increased; therefore, friction is more easily generated, so that it becomes possible to dampen more of impact energy.

Embodiment 3

In Embodiment 1, the configuration is adopted in which the switching-unit holder 6 and the switching unit 3 are integrally molded in one piece for an insulation purpose; however, as for a switchgear in which the switching-unit holder 6 and the switching unit 3 are not integrally molded in one piece, for example, in such a switchgear using insulation gas, similarly to the manner as set forth in Embodiment 1, it is possible to constitute the base plate 7 with a plurality of layered plates.

According to this configuration, similarly to the manner as set forth in Embodiment 1, because friction is generated between the layered plates of the base plate 7 due to distortion derived by an impact, kinetic energy is consumed, so that it is possible to curb chattering.

Figure 6:
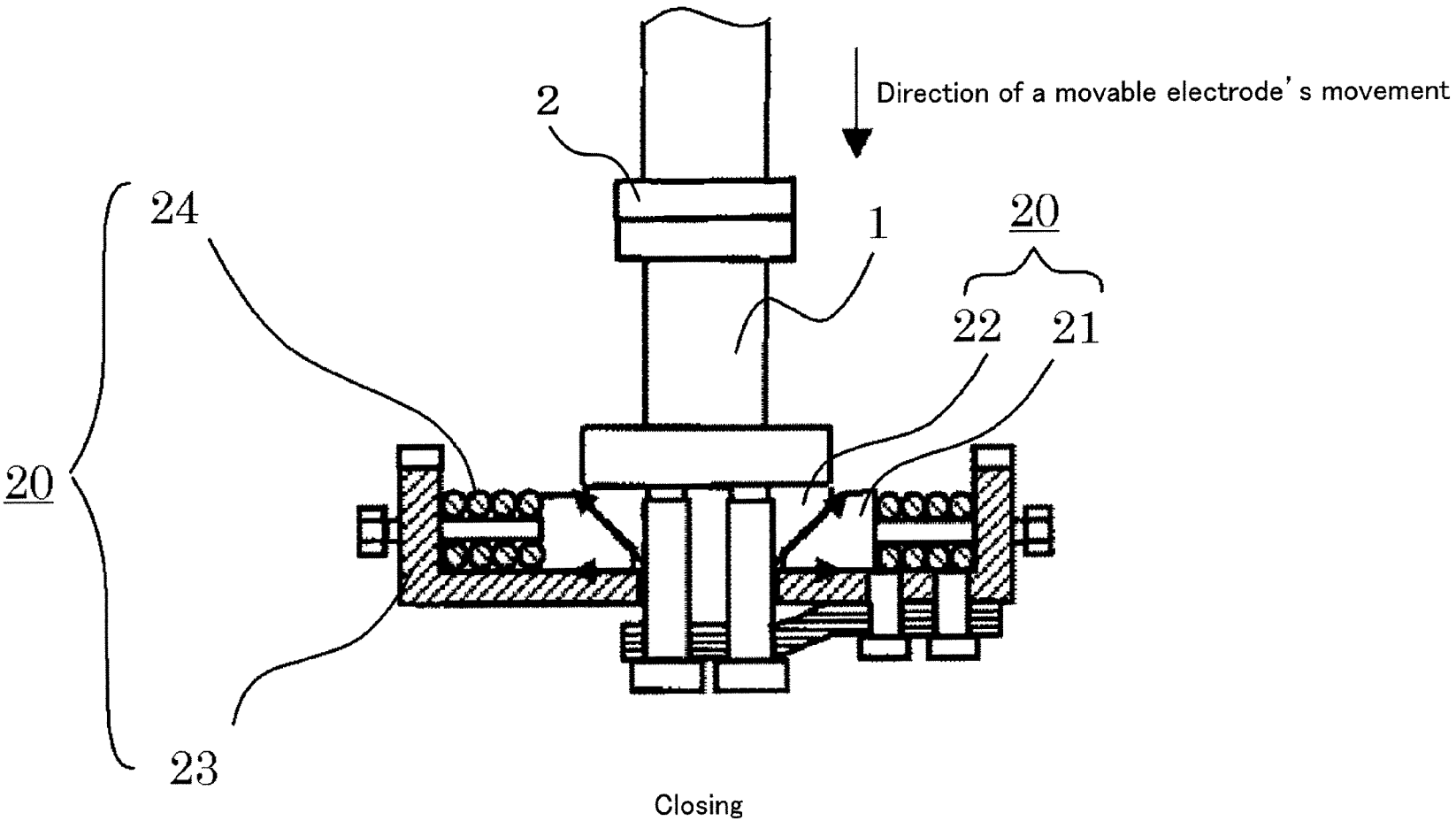
FIG. 6 is a cross-sectional diagram outlining a configuration of a fine movement mechanism in Embodiment 3 of the present invention.

In addition, in regard to the configuration in which the switching-unit holder 6 and the switching unit 3 are not integrally molded, it may be possible to realize the base plate 7 constituted of a plurality of layered plates, and also to place such a fine movement mechanism 20, as shown in FIG. 6, combined on the side of fixed electrode 1.

In a case in which the fine movement mechanism 20 is added, when a close operation is performed by the fixed electrode 1 and the movable electrode 2 which steeply make contact from separated locations between themselves so as to close an electric circuit, fixed-electrode-side movable blocks 22 are pushed downward in the fine movement mechanism 20; because, fixed-plate-side movable blocks 21 situated on the side of a fixed plate 23 are supported by springs 24 that expand and contract in left-hand and right-hand (lateral) directions, the fixed-plate-side movable blocks 21 laterally generate minute vibrations. Because of the minute vibrations, "work" is produced due to the frictional force on the contacting surfaces between the fixed-electrode-side movable blocks 22 and the fixed-plate-side movable blocks 21, and also on the contacting surfaces between the fixed-plate-side movable blocks 21 and the fixed plate 23; thus, it is possible to consume the kinetic energy by the amount of the product of the frictional force and the amount of shifting (i.e., "frictional force"×"the amount of shifting").

Note that, the frictional force is shown at four locations, below in FIG. 6, by the arrows each indicated with the heavy line.

Because of mutual action/reaction between the base plate 7 constituted of a plurality of layered plates and the fine movement mechanism 20, it becomes possible to consume more of the kinetic energy; therefore, it becomes possible to lower energy that allows the movable electrode 2 to bounce back and forth, so that it is possible to reduce a chattering time.

Embodiment 4

In Embodiment 2, the configuration is adopted in which a shape of the layered plates that compose the base plate 7 is partly waved in the same or identical shape, and each plate is layered on one another with its convexes and concaves neatly coincided; however, in regard to the configuration in Embodiment 1 or that in Embodiment 2, a surface or surfaces of the layered plates each may also be made rough.

According to this configuration, in a case in which the layered plates whose surfaces made rough are mutually distorted by the impact, because friction between the constituted plates is large, energy consumed by the friction becomes large; therefore, it becomes possible to lower energy that allows the movable electrode 2 to bounce back and forth, so that it is possible to reduce a chattering time.

Embodiment 5

In a case of a general circuit breaker, three of such switchgears are placed in a parallel configuration (corresponding to the three phases of "U," "V," and "W"); for this reason, usually, as described in Embodiment 1, three switchgears result in placed upon the base plate 7; however, it may be possible to independently (in isolation) place one such base plate 7 for each phase of a three-phase switchgear. In this case, it is preferable to constitute such base plate 7 each independently placed is supported by the struts 81 that are fixed upon one such flange 9 provided overall for supporting the three-phase switchgear.

According to this configuration, even a close-operation timing deviation is generated for each phase when a close operation is performed, it is possible to curb to minimize the influence in which mutual interference among the three phases due to the timing deviation exerts an effect upon a chattering time; therefore, it becomes possible to shorten the chattering time.

Embodiment 6

In each of Embodiment 1 through Embodiment 5 described above, the switching-unit holder 6 is fixed onto the flange 9 via the base plate 7 and the struts 81; however, instead of interposing the struts 81 and the base plate 7, it may be possible to constitute the switching-unit holder 6 which is directly fixed onto such flange 9 that is layered with plates. In this case, the flange 9 becomes the fixing plane that serves to fix the switching-unit holder 6 thereonto; it may be possible to realize a structure of the flange 9 (i.e., holder supporting plate or unit) that is similar to the structure of the base plate 7 described in Embodiment 1, Embodiment 2 and Embodiment 4.

According to the arrangement the flange 9 is layered, the flange 9 is distorted due to the impact produced by a close operation, and friction is produced between the layered plates that compose the flange 9; for this reason, according to the consumption of kinetic energy due to the friction, it becomes possible to lower kinetic energy that allows the movable electrode 2 to bounce back and forth, so that it is possible to reduce the time during which the chattering occurs.

Moreover, because the struts 81 that support the base plate 7 and the flange 9 are eliminated, the number of components is reduced, so that it is also possible to reduce costs.

While the present invention has been shown and described in detail, the foregoing description is in all aspects illustrative and not restrictive. It is therefore understood that numerous modifications and variations can be realized without departing from the scope of the invention.

What is claimed is:

1. A switchgear apparatus, comprising:

a switching unit including a movable electrode and a fixed electrode for opening/closing an electric circuit;

a movable shaft extended from the movable electrode;

an operating mechanism for performing, by providing driving force to said movable shaft, open/close operations of said switching unit;

a switching-unit holder for holding said switching unit and said movable shaft thereinside; and a holder supporting unit having a fixing plane, for fixing said switching-unit holder thereonto, the fixing plane including a plurality of plates layered in the axial direction along said movable shaft, the plurality of plates including convexes and concaves of a same shape.

2. The switchgear apparatus as set forth in claim 1, wherein the plurality of plates layered in the axial direction along the movable shaft are fastened by one or more fixing members.

3. The switchgear apparatus as set forth in claim 1, wherein each of the plurality of plates is provided with the convexes and concaves of the same shape, which are layered in the axial direction along the movable shaft such that the convexes and concaves of adjacent plates nest.

4. The switchgear apparatus as set forth in any one of claims 1 through 3, wherein the holder supporting unit serving as the fixing plane is independently provided for each phase of a three-phase switchgear.

5. The switchgear apparatus as set forth in any one of claims 1 through 3, wherein the switching unit and the switching-unit holder are integrally molded.

* * * * *